US010269369B2

(12) United States Patent
Bryan et al.

(10) Patent No.: US 10,269,369 B2
(45) Date of Patent: Apr. 23, 2019

(54) SYSTEM AND METHOD OF NOISE REDUCTION FOR A MOBILE DEVICE

(71) Applicant: Apple Inc., Cupertino, CA (US)

(72) Inventors: Nicholas J. Bryan, San Francisco, CA (US); Vasu Iyengar, Pleasanton, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/610,500

(22) Filed: May 31, 2017

(65) Prior Publication Data

US 2018/0350381 A1 Dec. 6, 2018

(51) Int. Cl.
*H04R 3/00* (2006.01)
*G10L 25/84* (2013.01)
(Continued)

(52) U.S. Cl.
CPC ..... *G10L 21/0232* (2013.01); *G10L 21/028* (2013.01); *G10L 21/0272* (2013.01); *G10L 25/84* (2013.01); *H04R 3/005* (2013.01); *G10L 2021/02082* (2013.01); *G10L 2021/02166* (2013.01)

(58) Field of Classification Search
CPC ..... G10L 2021/02087; G10L 21/0272
See application file for complete search history.

(56) References Cited

U.S. PATENT DOCUMENTS 5,353,376 A * 10/1994 Oh ..... G10L 15/20 379/88.01
9,253,566 B1 * 2/2016 Taenzer ..... H04R 3/005
(Continued)

FOREIGN PATENT DOCUMENTS

| | | | |
|---|---|---|---|
| CN | 101039486 | A | 9/2007 |
| WO | 00/38180 | A1 | 6/2000 |
| WO | 00/60830 | A2 | 10/2000 |

OTHER PUBLICATIONS

Kim, Taesu, Intae Lee, and Te-Won Lee. "Independent vector analysis: definition and algorithms." Signals, Systems and Computers, 2006. ACSSC'06. Fortieth Asilomar Conference on. IEEE, 2006. (Year: 2006).*

*Primary Examiner* — Brian L Albertalli
(74) *Attorney, Agent, or Firm* — Womble Bond Dickinson (US) LLP

(57) ABSTRACT

System of noise reduction for mobile devices includes blind source separator (BSS) and noise suppressor. BSS receives signals from at least two audio pickup channels. BSS includes sound source separator, voice source detector, equalizer, and auto-disabler. Sound source separator generates signals representing first sound source and second sound source based on signals from the first and the second channels. Voice source detector determines whether the signals representing the first and second sound sources are voice signal or noise signal, respectively. Equalizer scales noise signal to match a level of the voice signal, and generates scaled noise signal. Auto-disabler determines whether to disable BSS. Auto-disabler outputs signals from the at least two audio pickup channels when the BSS is disabled and outputs the voice signal and the scaled noise signal when the BSS is not disabled. Noise suppressor generates clean signal based on outputs from auto-disabler. Other embodiments are also described.

20 Claims, 6 Drawing Sheets

(51) Int. Cl.

| | |
|---|---|
| ***G10L 21/028*** | (2013.01) |
| ***G10L 21/0208*** | (2013.01) |
| ***G10L 21/0216*** | (2013.01) |
| ***G10L 21/0232*** | (2013.01) |
| ***G10L 21/0272*** | (2013.01) |

(56) References Cited

U.S. PATENT DOCUMENTS

| | | | | |
|---|---|---|---|---|
| 9,741,360 | B1 * | 8/2017 | Li | G10L 21/0232 |
| 9,749,737 | B2 * | 8/2017 | Nicholson | H04M 1/605 |
| 9,837,099 | B1 * | 12/2017 | Sundaram | G10L 21/028 |
| 2007/0021958 | A1 * | 1/2007 | Visser | G10L 21/0272<br>704/226 |
| 2010/0008519 | A1 | 1/2010 | Hayakawa et al. | |
| 2011/0038486 | A1 * | 2/2011 | Beaucoup | H04R 3/005<br>381/56 |
| 2012/0140946 | A1 * | 6/2012 | Yen | H04R 1/1083<br>381/92 |
| 2014/0278394 | A1 * | 9/2014 | Bastyr | G10L 21/0208<br>704/233 |
| 2014/0286497 | A1 * | 9/2014 | Thyssen | H04R 3/005<br>381/66 |
| 2016/0372129 | A1 * | 12/2016 | Nakadai | G10L 21/028 |

* cited by examiner

SYSTEM AND METHOD OF NOISE REDUCTION FOR A MOBILE DEVICE

FIELD

Embodiments of the invention relate generally to a system and method of noise reduction for a mobile device. Specifically, embodiments of the invention use blind source separation algorithms for improved noise reduction.

BACKGROUND

Currently, a number of consumer electronic devices are adapted to receive speech via microphone ports or headsets. While the typical example is a portable telecommunications device (mobile telephone), with the advent of Voice over IP (VoIP), desktop computers, laptop computers and tablet computers may also be used to perform voice communications.

When using these electronic devices, the user also has the option of using headphones, earbuds, or headset to receive his or her speech. However, a common complaint with these hands-free modes of operation is that the speech captured by the microphone port or the headset includes environmental noise such as wind noise, secondary speakers in the background or other background noises. This environmental noise often renders the user's speech unintelligible and thus, degrades the quality of the voice communication.

Noise suppression algorithms are commonly used to enhance speech quality in modern mobile phones, telecommunications, and multimedia systems. Such techniques remove unwanted background noises caused by acoustic environments, electronic system noises, or similar. Noise suppression may greatly enhance the quality of desired speech signals and the overall perceptual performance of communication systems. However, mobile device handset noise reduction performance can vary significantly depending on, for example: 1) the signal-to-noise ratio of the noise compared to the desired speech, 2) directional robustness or the geometry of the microphone placement in the mobile device relative to the unwanted noisy sounds, and 3) handset positional robustness or the geometry of the microphone placement relative to the desired speaker.

Related to multi-channel noise suppression processing is the field blind source separation (BSS). Blind source separation is the task of separating a set of two or more distinct sound sources from a set of mixed signals with little-to-no prior information. Blind source separation algorithms include independent component analysis (ICA), independent vector analysis (IVA), and non-negative matrix factorization (NMF). These methods are designed to be completely general and make no assumptions on microphone position or sound source.

However, blind source separation algorithms have several limitations that limit their real-world applicability. For instance, some algorithms do not operate in real-time, suffer from slow convergence time, exhibit unstable adaptation, and have limited performance for certain sound sources (e.g. diffuse noise) and microphone array geometries. Typical BSS algorithms may also be unaware of what sound sources they are separating, resulting in what is called the external "permutation problem" or the problem of not knowing which output signal corresponds to which sound source. As a result, BSS algorithms can mistakenly output the unwanted noise signal rather than the desired speech.

SUMMARY

Generally, embodiments of the invention relate to a system and method of noise reduction for a mobile device. Embodiments of the invention apply to wireless or wired headphones, headsets, phones, handsets, and other communication devices. By implementing improved blind source separation and noise suppression algorithms in the embodiments of the invention, the speech quality and intelligibility of the uplink signal is enhanced.

In one embodiment, a system of noise reduction for a mobile device comprises a blind source separator (BSS) and a noise suppressor. The BSS receives signals from at least two audio pickup channels including a first channel and a second channel. The signals from at least two audio pickup channels include signals from a plurality of sound sources. The BSS includes: a sound source separator, a voice source detector, an equalizer, and an auto-disabler. The sound source separator generates signals representative of the first sound source and the second sound source based on the signals from the first and the second channels. The voice source detector determines whether the signal representative of the first sound source is a voice signal or a noise signal and whether the signal representative of the second sound source is the voice signal or the noise signal, and outputs the output voice signal and the output noise signal. The equalizer scales the output noise signal to match a level of the output voice signal, and generates a scaled noise signal. The auto-disabler determines whether to disable the BSS. When the BSS is disabled, the auto-disabler output signals from at least two audio pickup channels. When the BSS is not disabled, the auto-disabler outputs the output voice signal and the scaled noise signal. The noise suppressor generates a clean signal based on outputs from the auto-disabler.

In another embodiment, a method of noise reduction for a mobile device starts with a BSS receiving signals from at least two audio pickup channels including a first channel and a second channel. The signals from at least two audio pickup channels include signals from a plurality of sound sources. The plurality of sound sources may include a first sound source and a second sound source. A sound source separator included in the BSS generates signals representative of the first sound source and the second sound source based on the signals from the first and the second channels. A voice source detector included in the BSS determines whether the signal representative of the first sound source is a voice signal or a noise signal and whether the signal representative of the second sound source is the voice signal or the noise signal. The voice detector outputs the output voice signal and the output noise signal. An equalizer included in the BSS generates a scaled noise signal by scaling the output noise signal to match a level of the output voice signal. An auto-disabler included in the BSS determines whether to disable the BSS. The auto-disabler outputs signals from the at least two audio pickup channels when the BSS is disabled, and outputs the output voice signal and the scaled noise signal when the BSS is not disabled. A noise suppressor generates a clean signal based on outputs from the auto-disabler.

In another embodiment, a computer-readable storage medium has instructions stored thereon, when executed by a processor, causes the processor to perform a method of noise reduction for the mobile device.

The above summary does not include an exhaustive list of all aspects of the present invention. It is contemplated that the invention includes all systems, apparatuses and methods that can be practiced from all suitable combinations of the various aspects summarized above, as well as those disclosed in the Detailed Description below and particularly pointed out in the claims filed with the application. Such combinations may have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one. In the drawings.

DETAILED DESCRIPTION

In the following description, numerous specific details are set forth. However, it is understood that embodiments of the invention may be practiced without these specific details. In other instances, well-known circuits, structures, and techniques have not been shown to avoid obscuring the understanding of this description.

In the description, certain terminology is used to describe features of the invention. For example, in certain situations, the terms "component," "unit," "module," and "logic" are representative of hardware and/or software configured to perform one or more functions. For instance, examples of "hardware" include, but are not limited or restricted to an integrated circuit such as a processor (e.g., a digital signal processor, microprocessor, application specific integrated circuit, a micro-controller, etc.). Of course, the hardware may be alternatively implemented as a finite state machine or even combinatorial logic. An example of "software" includes executable code in the form of an application, an applet, a routine or even a series of instructions. The software may be stored in any type of machine-readable medium.

Figure 1:
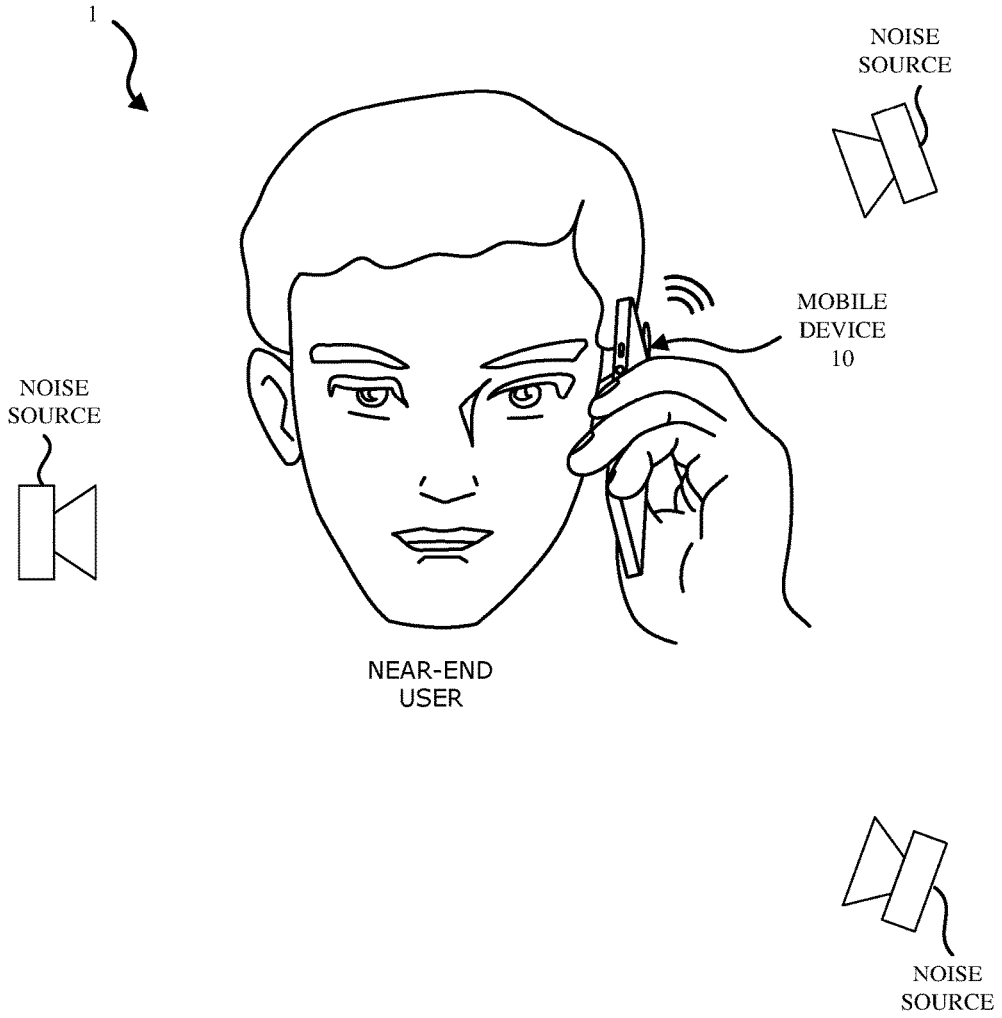
FIG. 1 illustrates an example of mobile device in use according to one embodiment of the invention.

FIG. 1 depicts near-end user using an exemplary electronic device 10 in which an embodiment of the invention may be implemented. The electronic device (or mobile device) 10 may be a mobile communications handset device such as a smart phone or a multi-function cellular phone. The sound quality improvement techniques using double talk detection and acoustic echo cancellation described herein can be implemented in such a user audio device, to improve the quality of the near-end audio signal. In the embodiment in FIG. 1, the near-end user is in the process of a call with a far-end user (not shown) who is using another communications device. The term "call" is used here generically to refer to any two-way real-time or live audio communications session with a far-end user (including a video call which allows simultaneous audio). The mobile device 10 communicates with a wireless base station in the initial segment of its communication link. The call, however, may be conducted through multiple segments over one or more communication networks, e.g. a wireless cellular network, a wireless local area network, a wide area network such as the Internet, and a public switch telephone network such as the plain old telephone system (POTS). The far-end user need not be using a mobile device, but instead may be using a landline based POTS or Internet telephony station.

While not shown, the mobile device 10 may also be used with a headset that includes a pair of earbuds and a headset wire. The user may place one or both of the earbuds into their ears and the microphones in the headset may receive their speech. The headset may be a double-earpiece headset. It is understood that single-earpiece or monaural headsets may also be used. As the user is using the headset or directly using the electronic device to transmit their speech, environmental noise may also be present (e.g., noise sources in FIG. 1). The headset may be an in-ear type of headset that includes a pair of earbuds which are placed inside the user's ears, respectively, or the headset may include a pair of earcups that are placed over the user's ears may also be used. Additionally, embodiments of the present disclosure may also use other types of headsets. Further, in some embodiments, the earbuds may be wireless and communicate with each other and with the electronic device 10 via BluetoothTM signals. Thus, the earbuds may not be connected with wires to the electronic device 10 or between them, but communicate with each other to deliver the uplink (or recording) function and the downlink (or playback) function.

Figure 2:
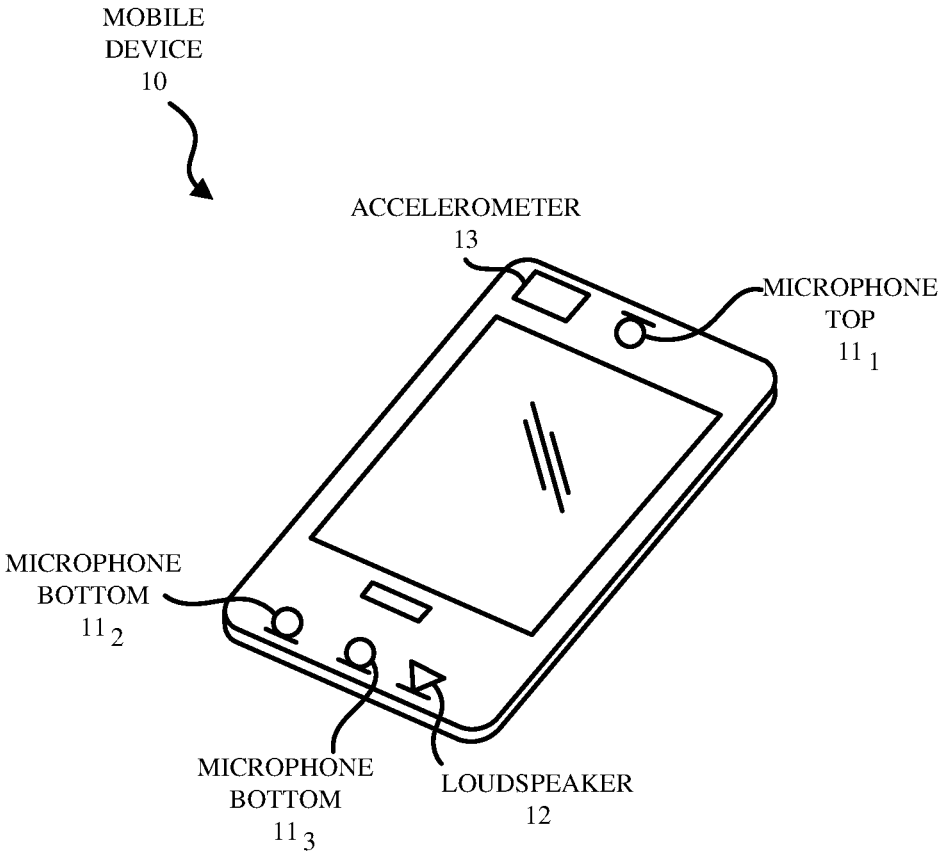
FIG. 2 illustrates an exemplary mobile device in which an embodiment of the invention may be implemented.

FIG. 2 depicts an exemplary mobile device 10 in which an embodiment of the invention may be implemented. As shown in FIG. 2, the mobile device 10 may include a housing having a bezel to hold a display screen on the front face of the device. The display screen may also include a touch screen. The mobile device 10 may also include one or more physical buttons and/or virtual buttons (on the touch screen). As shown in FIG. 2, the electronic device 10 may also include a plurality of microphones $\mathbf{11}_1$-$\mathbf{11}_n$ ($n \geq 1$), a loudspeaker 12, and an accelerometer 13. While FIG. 2 illustrates three microphones, it is understood that a plurality of microphones or a microphone array may be used.

The accelerometer 13 may be a sensing device that measures proper acceleration in three directions, X, Y, and Z or in only one or two directions. When the user is generating voiced speech, the vibrations of the user's vocal chords are filtered by the vocal tract and cause vibrations in the bones of the user's head which are detected by the accelerometer 13 in the mobile device 10. In other embodiments, an inertial sensor, a force sensor or a position, orientation and movement sensor may be used in lieu of the accelerometer 13. While FIG. 2 illustrates a single accelerometer, it is understood that a plurality of accelerometers may be used. In one embodiment, the signals from the accelerometer 13 may be used interchangeably with the signals from the microphones $\mathbf{11}_1$-$\mathbf{11}_n$.

The microphones $\mathbf{11}_1$-$\mathbf{11}_n$ ($n>1$) may be air interface sound pickup devices that convert sound into an electrical signal. In FIG. 2, a top front microphone $\mathbf{11}_1$ is located at the top of the mobile device 10. A first bottom microphone $\mathbf{11}_2$ and a second bottom microphone $\mathbf{11}_3$ are located at the bottom of the mobile device 10. In some embodiments, the loudspeaker 12 is also located at the bottom of the mobile device 10. In some embodiments, the microphones $\mathbf{11}_1$-$\mathbf{11}_3$ may be used to create a microphone array (i.e., beamformers) which can be aligned in the direction of user's mouth. As shown in FIG. 1, the microphones $\mathbf{11}_1$-$\mathbf{11}_3$ may be used to create microphone array beams (i.e., beamformers) which can be steered to a given direction by emphasizing and deemphasizing selected microphones $\mathbf{11}_1$-$\mathbf{11}_3$. Similarly, the microphone arrays can also exhibit or provide nulls in other given directions. Accordingly, the beamforming process, also referred to as spatial filtering, may be a signal processing technique using the microphone array for directional sound reception.

The loudspeaker 12 generates a speaker signal based on a downlink signal. The loudspeaker 12 thus is driven by an output downlink signal that includes the far-end acoustic signal components. As the near-end user is using the mobile device 10 to transmit their speech, ambient noise may also be present. Thus, the microphones $\mathbf{11}_1$-$\mathbf{11}_3$ capture the near-end user's speech as well as the ambient noise around the mobile device 10. The downlink signal that is output from a loudspeaker 12 may also be captured by the microphones $\mathbf{11}_1$-$\mathbf{11}_3$, and if so, the downlink signal that is output from the loudspeaker 12 could get fed back in the near-end device's uplink signal to the far-end device's downlink signal. This downlink signal would in part drive the far-end device's loudspeaker, and thus, components of this downlink signal would be included in the near-end device's uplink signal to the far-end device's downlink signal as echo. Thus, the microphone $\mathbf{11}_1$-$\mathbf{11}_3$ may receive at least one of: a near-end talker signal, ambient near-end noise signal, and the loudspeaker signal. The microphone generates a microphone uplink signal.

Electronic device 10 may also include input-output components such as ports and jacks. For example, openings (not shown) may form microphone ports and speaker ports (in use when the speaker phone mode is enabled or for a telephone receiver that is placed adjacent to the user's ear during a call). The microphones $\mathbf{11}_1$-$\mathbf{11}_n$ and loudspeaker 12 may be coupled to the ports accordingly.

Figure 3:
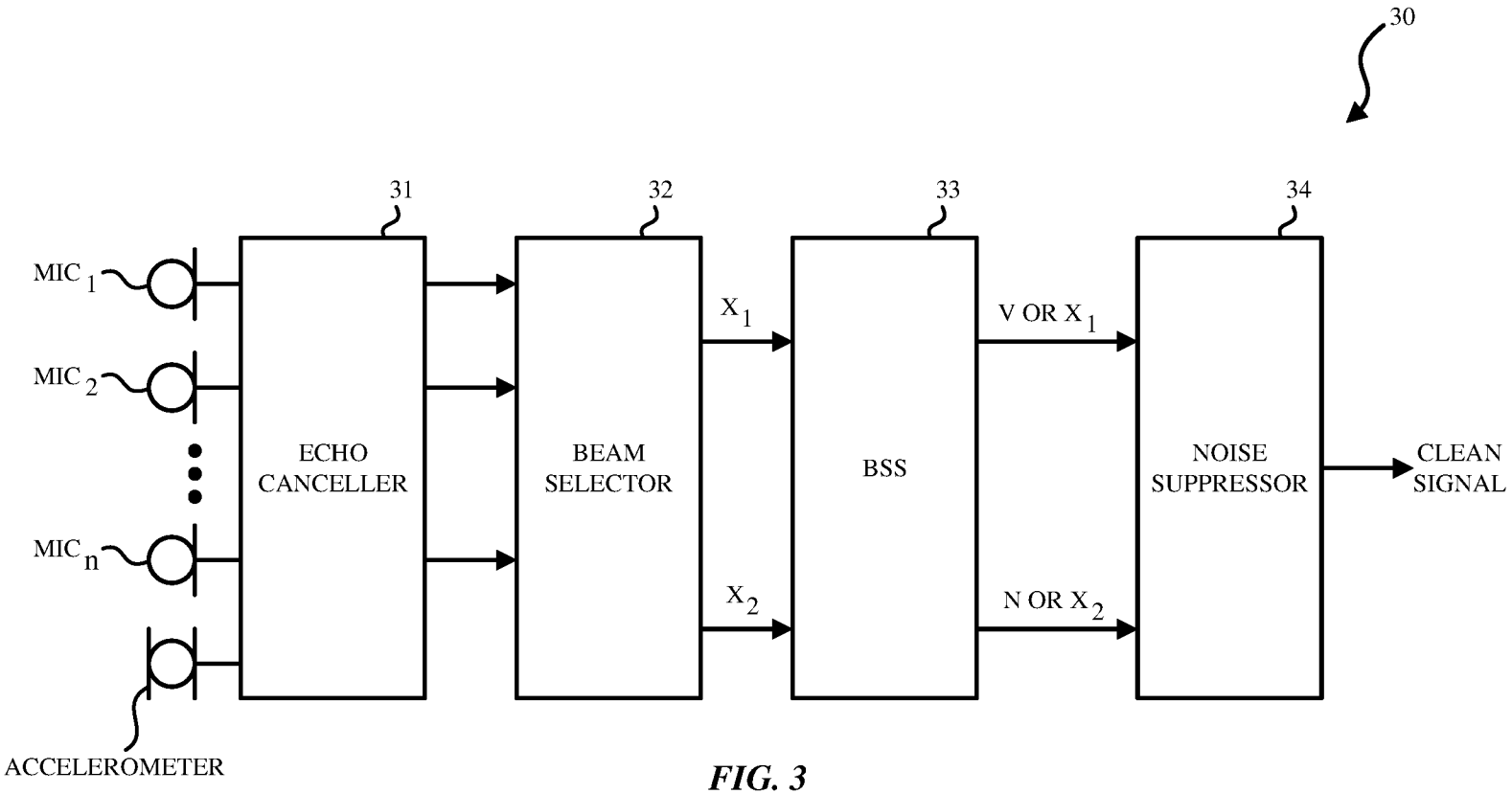
FIG. 3 illustrates a block diagram of a system of noise reduction for a mobile device according to an embodiment of the invention.

FIG. 3 illustrates a block diagram of a system 30 of noise reduction for a mobile device according to an embodiment of the invention. The system 30 includes an echo canceller 31, a beam selector 32, a blind source separator (BSS) 33 and a noise suppressor 34.

The echo canceller 31 may be an acoustic echo cancellers (AEC) that provides echo suppression. For example, the echo canceller 31 may remove a linear acoustic echo from acoustic signals from the microphones $\mathbf{11}_1$-$\mathbf{11}_n$. In one embodiment, the echo canceller 31 removes the linear acoustic echo from the acoustic signals in at least one of the bottom microphones $\mathbf{11}_2$, $\mathbf{11}_3$ based on the acoustic signals from the top microphone $\mathbf{11}_1$.

In some embodiments, the echo canceller 31 may also perform echo suppression and remove echo from sensor signals from the accelerometer 13. The sensor signals from the accelerometer 13 provide information on sensed vibrations in the x, y, and z directions. In one embodiment, the information on the sensed vibrations is used as the user's voiced speech signals in the low frequency band (e.g., 1000 Hz and under).

In one embodiment, the acoustic signals from the microphones $\mathbf{11}_1$-$\mathbf{11}_n$ and the sensor signals from the accelerometer 13 may be in the time domain. In another embodiment, prior to being received by the echo canceller 31 or after the echo canceller 31, the acoustic signals from the microphones $\mathbf{11}_1$-$\mathbf{11}_n$ and the sensor signals from the accelerometer 13 are first transformed from a time domain to a frequency domain by filter bank analysis. In one embodiment, the signals are transformed from a time domain to a frequency domain using Fast Fourier Transforms (FFTs). The echo canceller 31 may then output enhanced acoustic signals from the microphones $\mathbf{11}_1$-$\mathbf{11}_n$ that are echo cancelled acoustic signals from the microphones $\mathbf{11}_1$-$\mathbf{11}_n$. The echo canceller 31 may also output enhanced sensor signals from the accelerometer 13 that are echo cancelled sensor signals from the accelerometer 13.

The beam selector 32 receives from the echo canceller 31 the enhanced acoustic signals from microphones $\mathbf{11}_1$-$\mathbf{11}_n$ and enhanced sensor signals from the accelerometer 13 and outputs a first beamformer output signal ($X_1$) and a second beamformer output signal ($X_2$). In one embodiment, the first beamformer output signal ($X_1$) is a voice beam signal and the second beamformer output signal ($X_2$) is the noise beam signal. In one embodiment, the beam selector 32 may output the enhanced sensor signals from the accelerometer 13 as the first beamformer output signal ($X_1$). In another embodiment, the beam selector 32 includes a beamformer to receive the signals from the first bottom microphone $\mathbf{11}_2$ and a second bottom microphone $\mathbf{11}_3$ and create a beamformer that is aligned in the direction of the user's mouth to capture the user's speech. The output of the beamformer may be the voicebeam signal. In one embodiment, the beam selector 32 may also include a beamformer to generate a noisebeam signal using the signals from the top microphone $\mathbf{11}_1$ to capture the ambient noise or environmental noise.

By generating near-field beamformers and selecting the signals accordingly, the beam selector 32 accounts for changes in the geometry of the microphone placement relative to the desired speaker (e.g., the position the user is holding the handset). In addition to improving handset positional robustness, the beam selector 32 also increases the level of near-field voice relative to noise and improves the signal-to-noise ratio for different positions of the handset (e.g., up and down angles).

In order to provide directional noise robustness, the BSS 33 included in system 30 accounts for the change in the geometry of the microphone placement relative to the unwanted noisy sounds. The BSS 33 improves separation of the speech and noise in the signals by removing noise from the voicebeam signal and removing voice from the noisebeam signal.

The BSS 33 then receives the signals ($X_1$, $X_2$) from the beam selector 32. In some embodiments, these signals are signals from at least two audio pickup channels including a first channel and a second channel. While BSS 33 may be a two-channel BSS (e.g., for handsets), a BSS that receives more than two channels may be used. For example, a four-channel BSS may be used when addressing noise reduction for speakerphones. As shown in FIG. 3, the signals from at least two audio pickup channels include signals from a plurality of sound sources. For example, the sound sources may be the near-end speaker's speech, the loudspeaker signal including the far-end speaker's speech, environmental noises, etc.

Figure 4:
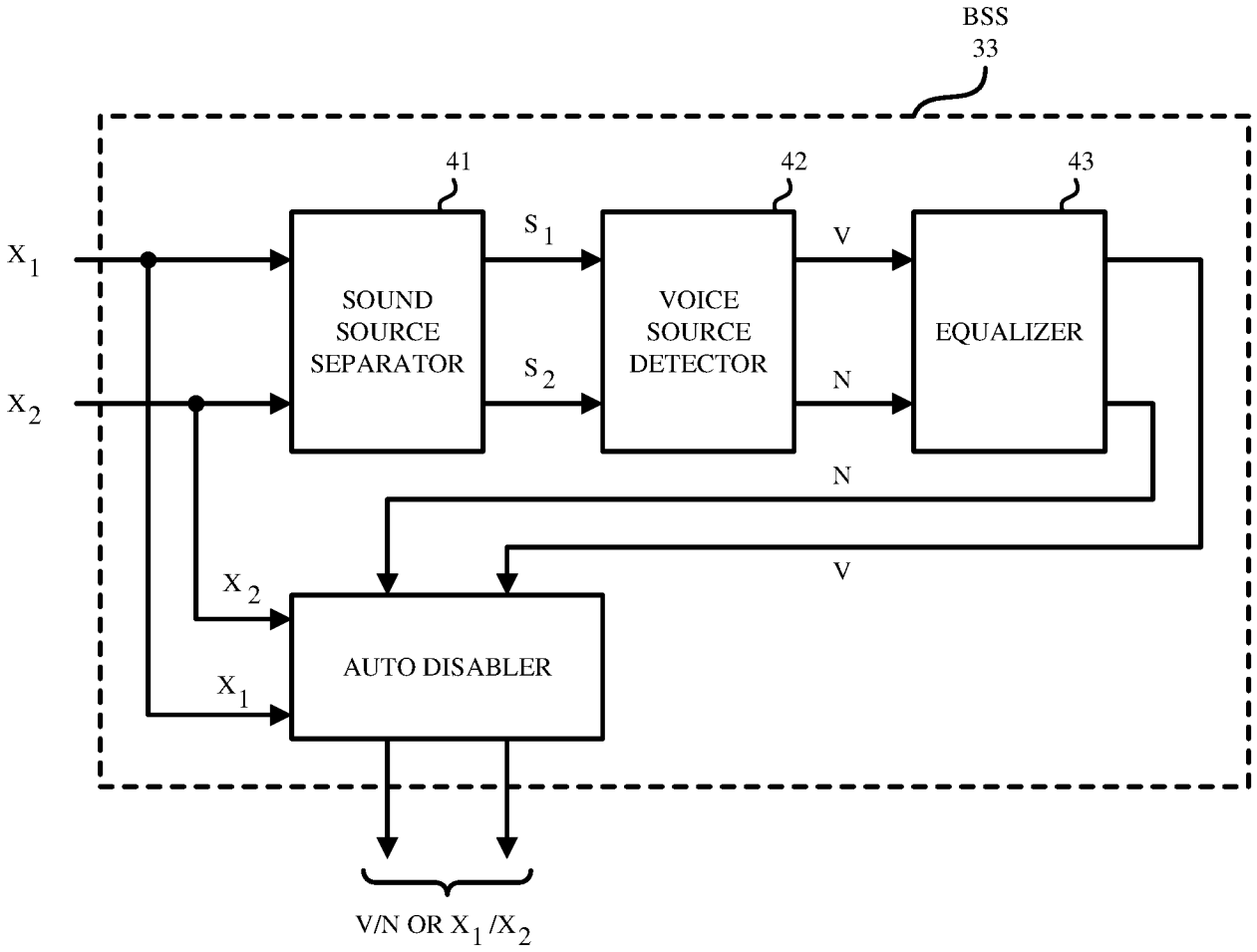
FIG. 4 illustrates a block diagram of the BSS included in the system of noise reduction for a mobile device in FIG. 3 according to an embodiment of the invention.

Referring to FIG. 4, a block diagram of the BSS 33 included in the system 30 of noise reduction for a mobile device in FIG. 3 is illustrated according to an embodiment of the invention. The BSS 33 includes a sound source separator 41, a voice source detector 42, an equalizer 43 and an auto-disabler 44.

In one embodiment, the sound source separator 41 separates x number sources from x number of microphones (x>2). In one embodiment, independent component analysis (ICA) may be used to perform this separation by the sound source separator 41. In FIG. 4, the sound source separator 41 receives signals from at least two audio pickup channels including a first channel and a second channel and the plurality of sources may include a speech source and a noise source. In one embodiment, when no noise source is present, the BSS 33 may generate a synthetic noise source. The synthetic noise source may include a low level of noise. Using a linear mixing model, observed signals (e.g., $X_1$, $X_2$) is the combination of unknown source signals (e.g., signals generated at the source ($S_1$, $S_2$)) and a mixing matrix A (e.g., representing the relative transfer functions in the environment between the sources and the microphones $\mathbf{11}_1$-$\mathbf{11}_3$). The model between these elements may be shown as follows:

$$x = As$$

$$\begin{bmatrix} x_1 \\ x_2 \end{bmatrix} = \begin{bmatrix} a_{11} & a_{12} \\ a_{21} & a_{22} \end{bmatrix} \begin{bmatrix} s_1 \\ s_2 \end{bmatrix}$$

Accordingly, an unmixing matrix W is the inverse of the mixing matrix A, such that the unknown source signals (e.g., signals generated at the source ($S_1$, $S_2$)) may be solved. Instead of estimating A and inverting it, however, the unmixing matrix W may also be directly estimated (e.g. to maximize statistical independence).

$$W=A^{-1}$$

$$s=Wx$$

In one embodiment, the unmixing matrix W may also be extended per frequency bin:

$$W[k]=A^{-1}[k]$$

The sound source separator 41 outputs the source signals $S_1$, $S_2$ (e.g., the signal representative of the first sound source and the signal representative of the second sound source).

In one embodiment, the observed signals ($X_1$, $X_2$) are first transformed from the time domain to the frequency domain using a Fast Fourier transform or by filter bank analysis as discussed above. The observed signals ($X_1$, $X_2$) may be separated into a plurality of frequencies or frequency bins (e.g., low frequency bin, mid frequency bin, and high frequency bin). In this embodiment, the sound source separator 41 computes or determines an unmixing matrix W for each frequency bin, outputs source signals $S_1$, $S_2$ for each frequency bin. However, when the sound source separator 41 solves the source signals $S_1$, $S_2$ for each frequency bin, the sound source separator 41 needs to further address the internal permutation problem so that the source signals $S_1$, $S_2$ for each frequency bin is aligned. To address the internal permutation problem, in one embodiment, independent vector analysis (IVA) is used wherein each source is modeled as a vector across a plurality of frequencies or frequency bins (e.g., low frequency bin, mid frequency bin, and high frequency bin). In one embodiment, the near-field ratio (NFR) may be computed or determined per frequency bin. In this embodiment, the NFR may be used to simultaneously solve both the internal and external permutation problems.

In one embodiment, the source signals $S_1$, $S_2$ for each frequency bin is then transformed from the frequency domain to the time domain. This transformation may be achieved by filter bank synthesis or other methods such as inverse Fast Fourier Transform (iFFT).

Once the source signals $S_1$ and $S_2$ are separated and output by the sound source separator 41, the external permutation problem needs to be solved by the voice source detector 42. The voice source detector 42 needs to determine which output signal $S_1$ or $S_2$ corresponds to the voice signal and which output signal $S_1$ or $S_2$ corresponds to the noise signal. Referring back to FIG. 4, the voice source detector 42 receives the source signals $S_1$, $S_2$ from the sound source separator 41. The voice source detector 42 determines whether the signal from the first sound source is a voice signal (V) or a noise signal (N) and whether the signal from the second sound source is the voice signal or the noise signal.

In one embodiment, the voice source detector 42 computes or determines the near-field ratio (NFR) of each estimated transfer function or relative transfer function between each of the first and second sound sources, respectively, and a plurality of microphones that receive the signals from the plurality of sound sources. The voice signal is determined by the voice detector 42 to be the signal associated with a highest NFR. In one embodiment, the voice source detector 42 computes the transfer functions between each source and each microphone using the mixing matrix and the unmixing matrix as follows:

$$A[k]=W[k]^{-1}$$

The voice source detector 42 then computes the energy or level of each estimated transfer function:

$$E = 10\log_{10}[\Sigma_k |A[k]|^2] = \begin{bmatrix} e_{11} & e_{12} \\ e_{21} & e_{22} \end{bmatrix}$$

The voice source detector 42 then computes or determines the ratio of energies or near-field ratio (NFR) per source:

$$\mathrm{NFR}_1=e_{11}-e_{21}$$

$$\mathrm{NFR}_2=e_{12}-e_{22}$$

The voice source detector 42 determines that the voice signal or voice beam signal is the signal from the source having the highest NFR. The voice source detector 42 then outputs the signal determined to be the voice signal as an output voice signal and the signal determined to be the noise signal as an output voice signal.

When using standard amplitude scaling rules (for example, the minimum distortion principle) to scale the output of an independent component analysis (ICA) or independent vector analysis (IVA), in the sound source separator 41, the level of the output noise signal may be over estimated. Accordingly, as shown in FIG. 4, the equalizer 43 receives the output voice signal and the output noise signal and scales the output noise signal to match a level of the output voice signal to generate a scaled noise signal.

In one embodiment, noise-only activity is detected by a voice activity detector (VAD) (not shown) using the signals $X_1$, $X_2$, the equalizer 43 generates a noise estimate in at least one of the bottom microphones $\mathbf{11}_2$, $\mathbf{11}_3$ or in the output of a beamformer that receives signals from the bottom microphones $\mathbf{11}_2$, $\mathbf{11}_3$. The equalizer 43 may generate a transfer function estimate from the top microphone $\mathbf{11}_1$ to at least one of the bottom microphones $\mathbf{11}_2$, $\mathbf{11}_3$. The equalizer 43 may then apply a gain to output noise signal (N) to match the level to output voice signal (V).

In one embodiment, the equalizer 43 determines a noise level in the output noise signal, which is a noise signal after separation by the BSS 33. In this embodiment, the equalizer 43 then estimates a noise level in output voice signal V and uses it to adjust output noise signal N appropriately to match the noise level after separation by the BSS 33. In this embodiment, the scaled noise signal is an output noise signal after separation by the BSS 33 that matches a residual noise found in the output voice signal after separation by the BSS 33.

The auto-disabler 44 receives the signals $X_1$, $X_2$ which have not been processed by the components in the BSS 33 as well as the output voice signal from the voice source detector 42 and the scaled noise signal from the equalizer 43. The auto-disabler 44 may disable the BSS 33 when the auto-disabler 44 determines that the BSS 33 is generating an output voice signal and a scaled noise signal that are less adequate than the signals $X_1$, $X_2$. For example, BSS 33 issues may arise due to the pre-convergence region, changes in position of the mobile device, changes in the beam selector 32, directional noise being the same direction of arrival (DOA) as the voice signal, etc.

In one embodiment, when voice activity is detected by a voice activity detector (VAD) (not shown) using the signals $X_1$, $X_2$, the auto-disabler 44 may disable the BSS 33, for example: (i) when the directional source is the same as the direction of arrival of the voice signal, (ii) when the NFR of the output voice signal or the scaled noise signal is outside a predetermined range, or (iii) when there is a change in the beam selector 32 (e.g., changing direction of the beamformer).

In one embodiment, the auto-disabler 44 outputs signals $X_1$, $X_2$ when the BSS 33 is disabled, and outputs the output voice signal and the scaled noise signal when the BSS 33 is not disabled.

In one embodiment, a voice activity detector (VAD) (not shown) may also be coupled to the BSS 33 to modify the BSS update algorithm, which improves the convergence and reduces the speech distortion. For instance, the independent vector analysis (IVA) algorithm performed in the BSS 33 may be enhanced using a voice activity detector (VAD).

The VAD may receive the signals from the beamformer ($X_1$, $X_2$) or may receive the enhanced acoustic signals from the microphones $\mathbf{11}_1$-$\mathbf{11}_n$ from the echo canceller 31. The VAD may generate a VAD output based on an analysis of the energy levels of microphones $\mathbf{11}_1$-$\mathbf{11}_3$. For example, the VAD may generate a VAD output that indicates that speech is detected in the signal when the energy level of the bottom microphones $\mathbf{11}_2$, $\mathbf{11}_3$ is greater than the energy level of the top microphone $\mathbf{11}_1$.

In this embodiment, the internal state variables of the BSS update algorithm are modulated based on the external VAD's outputs. In another embodiment, the statistical model used for separation is biased (e.g. using a parameterize prior probability distribution) based on the external VAD's outputs to improve convergence. For example, when no speech is detected by the VAD in the signals from the beamformer ($X_1$, $X_2$), the voice beam generated by the beam selector 32 may be frozen (e.g., stop altering the directions of the voice beam). Once the voice beam is frozen, the voice source selector 42 is able to determine which beam is the voice beam signal. By using the VAD, the computation time required by the voice source selector 42 is significantly reduced.

Referring back to FIG. 3, the noise suppressor 34 receives either the signals $X_1$, $X_2$ from echo canceller 31 via the auto-disabler 44 or the output voice signal and the scaled noise signal from the auto-disabler 44. The noise suppressor 34 may suppress noise in the signals received from the auto-disabler 44. For example, the noise suppressor 34 may remove at least one of a residual noise or a non-linear acoustic echo in the signal to generate the clean signal. The noise suppressor 34 may be a one-channel or two-channel noise suppressor or residual echo suppressor.

The following embodiments of the invention may be described as a process, which is usually depicted as a flowchart, a flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed. A process may correspond to a method, a procedure, etc.

Figure 5:
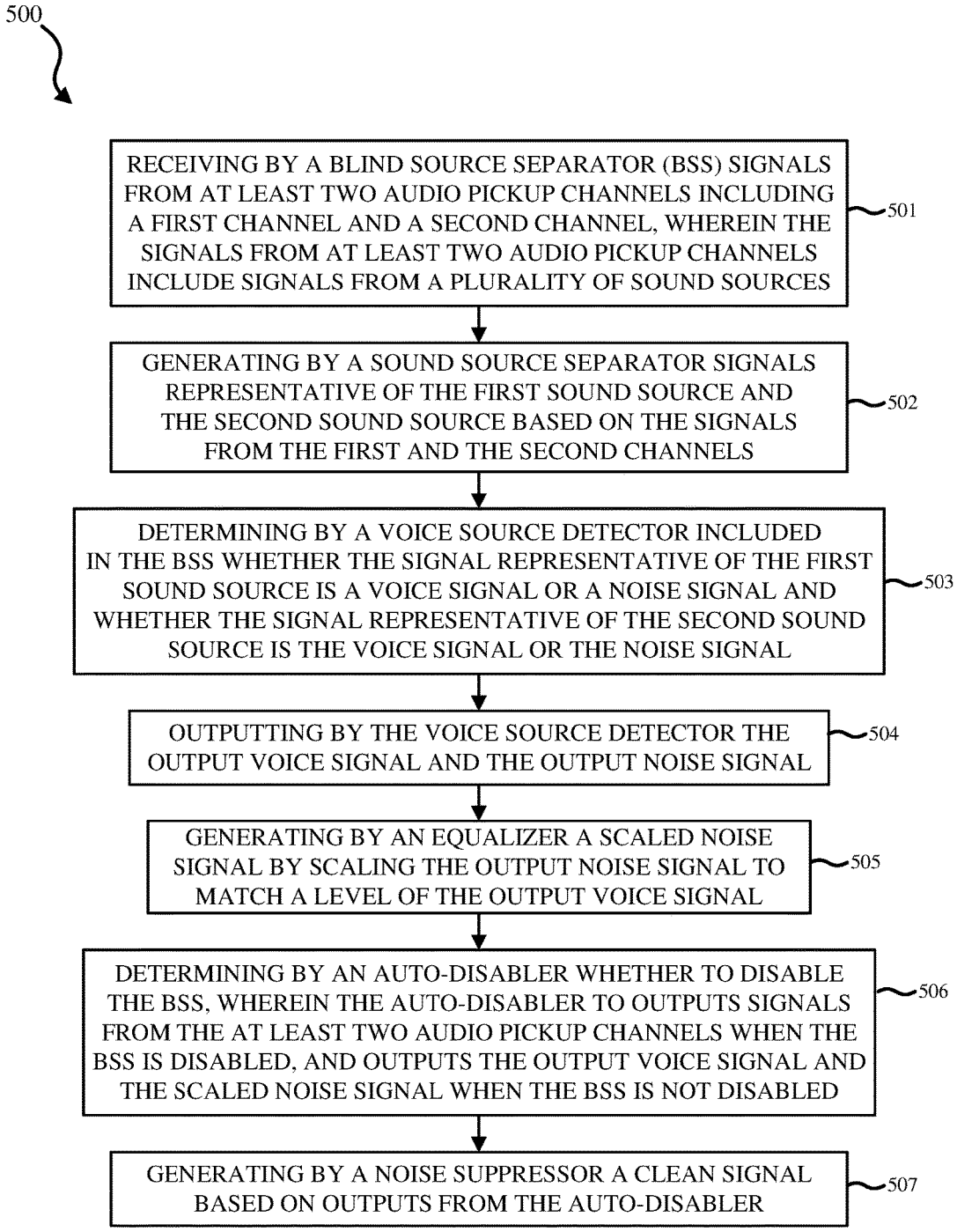
FIG. 5 illustrates a flow diagram of an example method of noise reduction for a mobile device according to one embodiment of the invention.

FIG. 5 illustrates a flow diagram of an example method 500 of noise reduction for a mobile device according to one embodiment of the invention. The method 500 starts with a blind source separator (BSS) receiving signals from at least two audio pickup channels including a first channel and a second channel at Block 501. The signals from at least two audio pickup channels may include signals from a plurality of sound sources. At Block 502, a sound source separator to generate signals from the first sound source and the second sound source based on the signals from the first and the second channels. At Block 503, a voice source detector included in the BSS determines whether the signal from the first sound source is a voice signal or a noise signal and whether the signal from the second sound source is the voice signal or the noise signal. At Block 504, the voice source detector outputs the voice signal and the noise signal. At Block 505, an equalizer included in the BSS generates a scaled noise signal by scaling the noise signal to match a level of the voice signal. At Block 506, an auto-disabler included in the BSS determines whether to disable the BSS. When the auto-disabler determines to disable the BSS, the auto-disabler disables the BSS and outputs signals from the at least two audio pickup channels. When the auto-disabler determines not to disable the BSS, the auto-disabler outputs the voice signal and the scaled noise signal. At Block 507, a noise suppressor generates a clean signal based on outputs from the auto-disabler.

Figure 6:
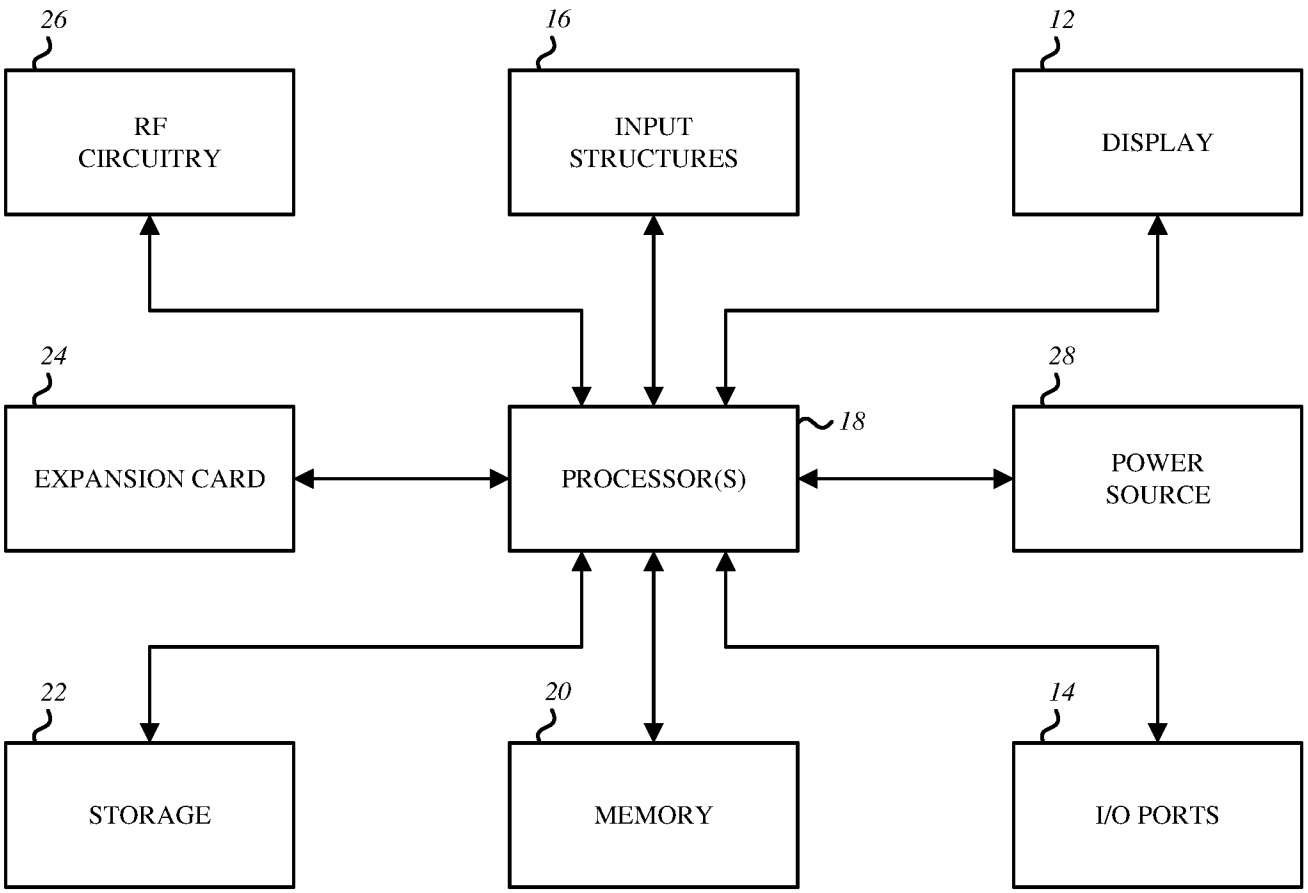
FIG. 6 is a block diagram of exemplary components of an electronic device in which embodiments of the invention may be implemented in accordance with aspects of the present disclosure.

FIG. 6 is a block diagram of exemplary components of an electronic device in which embodiments of the invention may be implemented in accordance with aspects of the present disclosure. Specifically, FIG. 6 is a block diagram depicting various components that may be present in electronic devices suitable for use with the present techniques. The electronic device 10 may be in the form of a computer, a handheld portable electronic device such as a cellular phone, a mobile device, a personal data organizer, a computing device having a tablet-style form factor, etc. These types of electronic devices, as well as other electronic devices providing comparable voice communications capabilities (e.g., VoIP, telephone communications, etc.), may be used in conjunction with the present techniques.

Keeping the above points in mind, FIG. 6 is a block diagram illustrating components that may be present in one such electronic device, and which may allow the device 10 to function in accordance with the techniques discussed herein. The various functional blocks shown in FIG. 6 may include hardware elements (including circuitry), software elements (including computer code stored on a computer-readable medium, such as a hard drive or system memory), or a combination of both hardware and software elements. It should be noted that FIG. 6 is merely one example of a particular implementation and is merely intended to illustrate the types of components that may be present in the electronic device 10. For example, in the illustrated embodiment, these components may include a display 12, input/output (I/O) ports 14, input structures 16, one or more processors 18, memory device(s) 20, non-volatile storage 22, expansion card(s) 24, RF circuitry 26, and power source 28.

An embodiment of the invention may be a machine-readable medium having stored thereon instructions which program a processor to perform some or all of the operations described above. A machine-readable medium may include any mechanism for storing or transmitting information in a form readable by a machine (e.g., a computer), such as Compact Disc Read-Only Memory (CD-ROMs), Read-Only Memory (ROMs), Random Access Memory (RAM), and Erasable Programmable Read-Only Memory (EPROM). In other embodiments, some of these operations might be performed by specific hardware components that contain hardwired logic. Those operations might alternatively be performed by any combination of programmable computer components and fixed hardware circuit components.

While the invention has been described in terms of several embodiments, those of ordinary skill in the art will recognize that the invention is not limited to the embodiments described, but can be practiced with modification and alteration within the spirit and scope of the appended claims. The description is thus to be regarded as illustrative instead of limiting. There are numerous other variations to different aspects of the invention described above, which in the interest of conciseness have not been provided in detail. Accordingly, other embodiments are within the scope of the claims.

The invention claimed is:

1. A system of noise reduction for a mobile device comprising:

a blind source separator (BSS)

to receive signals from at least two audio pickup channels including a first channel and a second channel, wherein the signals from at least two audio pickup channels include signals from a plurality of sound sources, wherein the BSS includes:

a sound source separator to generate a signal representative of a first sound source of a plurality of sound sources and a signal representative of a second sound source of the plurality of sound sources based on the signals from the first and the second channels, a voice source detector to determine whether the signal representative of the first sound source is a voice signal or a noise signal and whether the signal representative of the second sound source is the voice signal or the noise signal, and to output the signal determined to be the voice signal as an output voice signal and the signal determined to be the noise signal as an output noise signal, an equalizer to generate a scaled noise signal by scaling the output noise signal to match a level of the output voice signal, and an auto-disabler to determine whether to disable the BSS based on determining a near field ratio (NFR) of each estimated transfer function or relative transfer function between each of the first and second sound sources, respectively, and a plurality of microphones that receive the signals from the plurality of sound sources, and wherein the voice signal is associated with a highest NFR, to output signals from the at least two audio pickup channels when the BSS is disabled, and to output the output voice signal and the scaled noise signal when the BSS is not disabled; and a noise suppressor to generate a clean signal based on outputs from the auto-disabler.

2. The system in claim 1, wherein the first channel is from an accelerometer and the second channel is from a microphone.

3. The system in claim 1, further comprising:

a beamformer to receive the signals from at least two microphones to generate a beamformer signal, wherein the first channel includes the beamformer signal.

4. The system in claim 1, wherein the plurality of sound sources includes a speech source and a noise source.

5. The system of claim 1, wherein generating, by the sound source separator, the signal representative of the first sound source and the signal representative of the second sound source based on the signals from the first and the second channels includes:

determining an unmixing matrix W, and determining the signal representative of the first sound source and the signal representative of the second sound source based on the unmixing matrix W and the signals from the first and the second channels.

6. The system of claim 5, wherein the signal representative of the first sound source and the signal representative of the second sound source are separated in a plurality of frequency bins in a frequency domain and independent vector analysis (IVA) is used to align the signals representative of the first and the second sound sources across the frequency bins.

7. The system of claim 1, further comprising a voice activity detector (VAD), wherein internal state variables of an update algorithm of the BSS are modulated based on the VAD's output, or a statistical model used for separation in the BSS is biased in the form of a prior probability distribution based on the VAD's output to improve convergence.

8. The system of claim 1, wherein the equalizer is further used to:

determine a level in the output noise signal after separation by the BSS, and estimate a level in the output voice signal after separation by the BSS.

9. The system of claim 1, wherein the auto-disabler disables the BSS when a near field ratio exceeds a predetermined range.

10. The system of claim 1, wherein the noise suppressor is a 1-channel or a 2-channel noise suppressor.

11. A method of noise reduction for a mobile device comprising:

receiving by a blind source separator (BSS) signals from at least two audio pickup channels including a first channel and a second channel, wherein the signals from at least two audio pickup channels include signals from a plurality of sound sources, generating by a sound source separator included in the BSS signals representative of a first sound source of the plurality of sound sources and the signal from representative of a second sound source of the plurality of sound sources based on the signals from the first and the second channels;

determining by a voice source detector included in the BSS whether the signal representative of the first sound source is a voice signal or a noise signal and whether the signal representative of the second sound source is the voice signal or the noise signal;

outputting by the voice source detector the signal determined to be the voice signal as an output voice signal and the signal determined to be the noise signal as an output noise signal;

generating by an equalizer included in the BSS a scaled noise signal by scaling the output noise signal to match a level of the output voice signal;

determining by an auto-disabler included in the BSS whether to disable the BSS based on determining a near field ratio (NFR) of each estimated transfer function between each of the first and second sound sources, respectively, and a plurality of microphones that receive the signals from the plurality of sound sources, and wherein the voice signal is associated with a highest NFR;

outputting by the auto-disabler signals from the at least two audio pickup channels when the BSS is disabled;

outputting by the auto-disabler the output voice signal and the scaled noise signal when the BSS is not disabled; and generating by a noise suppressor a clean signal based on outputs from the auto-disabler.

12. The method in claim 11, wherein the first channel is from an accelerometer and the second channel is from a microphone.

13. The method in claim 11, further comprising:

receiving by a beamformer the signals from at least two microphones; and generating by the beamformer a beamformer signal, wherein the first channel includes the beamformer signal.

14. The method in claim 11, wherein the plurality of sound sources includes a speech source and a noise source.

15. The method of claim 11, wherein the sound source separator generating signals representative of the first sound source and the second sound source based on the signals from the first and the second channels includes:

determining an unmixing matrix W, and determining the signals representative of the first sound source and the second sound source based on the unmixing matrix W and the signals from the first and the second channels.

16. The method of claim 15, wherein the signal representative of the first sound source and the signal representative of the second sound source are separated in a plurality of frequency bins in a frequency domain and independent vector analysis (IVA) is used to align the signals representative of the first and the second sound sources across the frequency bins.

17. The method of claim 11, further comprising:

determining by the equalizer a noise level in the output noise signal, wherein the output noise signal is a noise signal after separation by the BSS, and estimating by the equalizer a noise level in the signals from at least two audio pickup channels, wherein the signals from the at least two audio pickup channels indicate a noise level found in the output voice signal after separation by the BSS.

18. The method of claim 11, wherein the auto-disabler disables the BSS when a near field ratio exceeds a predetermined range.

19. The method of claim 11, wherein the noise suppressor is a 1-channel or a 2-channel noise suppressor.

20. A computer-readable storage medium, having instructions stored thereon, when executed by a processor, causes the processor to perform a method of noise reduction for a mobile device comprising:

receiving signals from at least two audio pickup channels including a first channel and a second channel for blind source separation, wherein the signals from at least two audio pickup channels include signals from a plurality of sound sources, generating signals representative of a first sound source of the plurality of sound sources and the signal representative of a second sound source of the plurality of sound sources based on the signals from the first and the second channels;

determining whether the signal representative of the first sound source is a voice signal or a noise signal and whether the signal representative of the second sound source is the voice signal or the noise signal;

outputting the signal determined to be the voice signal as an output voice signal and the signal determined to be the noise signal as an output noise signal;

generating a scaled noise signal by scaling the output noise signal to match a level of the output voice signal;

determining to disable the BSS when voice activity is detected and when (i) a directional source is the same as a direction of arrival of the voice signal, (ii) a near field ratio of the output voice signal or the scaled noise signal is outside a predetermined range, or (iii) there is a change in a beam selector; and outputting signals from the at least two audio pickup channels, instead of the output voice signal and the scaled noise signal, when the BSS is disabled.

* * * * *